US005085961A

United States Patent [19]

Gregory et al.

[11] Patent Number: 5,085,961

[45] Date of Patent: Feb. 4, 1992

[54] MULTILAYER ORGANIC PHOTOCONDUCTOR

[75] Inventors: Peter Gregory, Bolton; Raymond White, Radcliffe, both of England

[73] Assignee: Imperial Chemical Industries plc, London, England

[21] Appl. No.: 632,659

[22] Filed: Dec. 27, 1990

Related U.S. Application Data

[63] Continuation of Ser. No. 347,009, May 4, 1989, abandoned.

[30] Foreign Application Priority Data

May 6, 1988 [GB] United Kingdom ..... 8810687

[51] Int. Cl.[5] ..... G03G 5/047

[52] U.S. Cl. ..... 430/59; 430/58

[58] Field of Search ..... 430/58, 59

[56] References Cited

U.S. PATENT DOCUMENTS

| | | | |
|---|---|---|---|
| 3,992,205 | 11/1976 | Wiedemann | 430/58 |
| 4,066,455 | 1/1978 | Mey et al. | 430/59 |
| 4,078,925 | 3/1978 | Horgar | 430/59 |
| 4,755,443 | 7/1988 | Suzuki et al. | 430/58 |
| 4,855,202 | 8/1989 | Yoshihara et al. | 430/59 X |
| 4,882,254 | 11/1989 | Loutfy et al. | 430/59 |

FOREIGN PATENT DOCUMENTS

| | | | |
|---|---|---|---|
| 0092255 | 10/1983 | European Pat. Off. . | |
| 0093331 | 11/1983 | European Pat. Off. . | |
| 63-257762 | 10/1988 | Japan | 430/59 |

OTHER PUBLICATIONS

Patent Abstract of Japan No. A-63-148264, vol. 12, No. 411 (1988).

Patent Abstract of Japan No. A-62-198864, vol. 12, No. 51 (1986).

Patent Abstract of Japan No. A-60-243659, vol. 10, No. 11 (1986).

*Primary Examiner*—Roland Martin

*Attorney, Agent, or Firm*—Cushman, Darby & Cushman

[57] ABSTRACT

An organic photoconductor comprising an electrically conducting support, a charge generation layer and a charge transport layer wherein the charge generation layer contains a phthalocyanine and dibromoanthanthrone.

6 Claims, No Drawings

MULTILAYER ORGANIC PHOTOCONDUCTOR

This is a continuation of application Ser. No. 07/347,009, filed on May 4, 1989, abandoned upon the filing hereof.

This invention relates to an organic photoconductor for use as the photosensitive element of an electrophotographic device such as a copier or printer.

Organic photoconductor (OPC) or photoreceptor devices used in electrophotographic copiers and printers generally comprise an electrically conducting support, a charge generation layer (CGL) and a charge transport layer (CTL). The conductive support is typically an aluminium drum or an aluminised polyester film. The charge generation layer contains a charge generating material (CGM), which is usually a pigment, and a binder resin which is typically a polycarbonate. The charge transport layer contains a charge transport material (CTM), which is usually a colourless, electron-rich organic molecule having a low ionisation potential and a binder resin, usually a polycarbonate.

The charge generation layer, commonly having a thickness of from 0.1 to 3 μm, is usually bonded to the conductive support by means of a thin layer of adhesive (about 0.1 μm), the charge transfer layer (about 15 μm) overlying the charge generation layer.

Typical chemical classes of CGMs include phthalocyanines, polycyclic quinones and various azo, squarilium and thiapyrilium compounds. Typical CTMs include hydrazones, leuco triphenylmethanes, pyrazolines, oxadiazoles, stilbenes and various conjugated amines such as triarylamines and tetraarylbenzidines. For effective performance, both the CGM and the CTM must be of very high purity.

In general, white light copiers use a CGM which spans as much as possible of the visible spectrum (400–700 nm). Typically, these are red pigments since these have maximum spectral sensitivity in the middle of the visible spectrum at about 550 nm.

The new generation of laser printers use solid state semi-conductor lasers which emit in the near infra-red at about 800 nm and so require CGMs sensitive in this region. LED printers contain light-emitting diodes (LEDs) which emit in the red region of the visible spectrum at 630–680 nm. Hence, a CGM with high sensitivity in this region is needed for LED printers.

The optimum OPC would have high spectral sensitivity across the whole visible spectrum and also, if desired, across the near infra-red spectrum. Improved spectral sensitivity in the visible region, especially in the red region, is desirable to improve the copying of blue inks and to improve the sensitivity to LEDs. Thus, a single panchromatic visible OPC could be used for copiers giving improved copy performance and for LED printers. A visible/near infra-red panachromatic OPC could be used for copiers, LED printers and laser printers. The manufacture of one OPC drum or belt, rather than two or three as at present, would then be possible and would offer considerable savings in manufacturing costs.

It has now been found that when the charge generation layer contains both a phthalocyanine and dibromoanthanthrone, the resulting OPC exhibits high sensitivity over a wide range of the visible spectrum and that this high sensitivity can be extended into the near infra-red by appropriate selection of materials. This is a completely unexpected result since the addition of a second CGM to a first CGM can be regarded as equivalent to adding an impurity which generally produces a deterioration in OPC performance.

Accordingly, the invention provides an organic photoconductor comprising an electrically conducting support, a charge generation layer and a charge transport layer wherein the charge generation layer contains a phthalocyanine and dibromoanthanthrone.

The phthalocyanine present in the CGL is preferably a metal-free phthalocyanine, the alpha- and beta-polymorphic forms, together with the dibromoanthanthrone giving a panchromatic effect over the visible spectrum and the X-form giving the effect over the visible spectrum and the near infra-red.

The weight proportions of phthalocyanine and dibromoanthanthrone in the CGL may vary from 0.1:99.9 to 99.9:0.1 but preferred mixtures contain from 5 to 50% by weight of the phthalocyanine.

The charge transport layer present in the OPC of the invention may contain a conventional charge transport material, for example a leuco di- or tri-arylmethane, a hydrazone, a tetraaryl benzidine or a triarylamine.

Di- and triarylmethane compounds which may be used as CTM's include compounds of the formula:

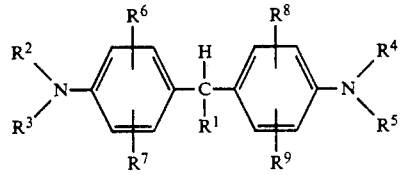

(1)

wherein $R^1$ represents hydrogen or an optionally substituted alkyl, alkenyl, cycloalkyl, cycloalkenyl, aralkyl or aryl radical;

each of $R^2$, $R^3$, $R^4$ and $R^5$, independently, represents hydrogen or an optionally substituted alkyl, alkenyl, cycloalkyl, aralkyl or aryl radical, or $R^2$ and $R^3$ together with the attached nitrogen atom and $R^4$ and $R^5$ together with the attached nitrogen atom may form heterocyclic rings; and each of $R^6$, $R^7$, $R^8$ and $R^9$, independently, represents a hydrogen or halogen atom or a hydroxy, alkyl or alkoxy group.

Halogen atoms which may be present as substituents in the compounds of Formula 1 particularly include chlorine and bromine atoms.

Alkyl and alkoxy radicals which may be present in the compounds of Formula 1 preferably contain from 1 to 4 carbon atoms. Substituents which may be present on such radicals include halogen atoms and hydroxy and alkoxy groups.

Alkenyl radicals which may be present in the compounds of Formula 1 preferably have from 2 to 4 carbon atoms and cycloalkenyl radicals preferably have from 5 to 7 carbon atoms.

Cycloalkyl radicals which may be present in the compounds of Formula 1 preferably contain from 5 to 7 carbon atoms, for example cyclohexyl.

Aralkyl radicals which may be present in the compounds of Formula 1 particularly include phenylalkyl radicals such as benzyl and phenylethyl.

Aryl radicals which may be present in the compounds of Formula 1 particularly include phenyl radicals.

Heterocyclic rings which may be present in the compounds of Formula 1 due to $R^2$ and $R^3$ and/or $R^4$ and $R^5$ being joined together typically contain from 5 to 7 atoms. Examples of such rings include pyrrolidine, piperidine and morpholine rings.

Hydrazone compounds which may be used as CTMs include compounds of the formula:

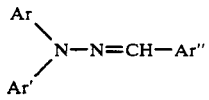

(2)

wherein each of Ar, Ar' and Ar'', independently represents a phenyl or naphthyl radical, each of which may optionally carry one or more non-ionic substituents.

In preferred hydrazones, Ar is phenyl, Ar' is phenyl or 1- or 2-naphthyl and Ar'' is either 1- or 2-naphthyl or a 4-aminophenyl radical wherein the amino group is preferably secondary or, especially, a tertiary amino group having alkyl, aralkyl or aryl substituents. It may sometimes be advantageous to use a CTM comprising a mixture of a compound of Formula 1 and a compound of Formula 2, for example a mixture of from 50 to 95% by weight of a compound of Formula 1 and from 50 to 5% by weight of a compound of Formula 2.

Tetraarylbenzidine compounds which may be used as CTMs are of the general formula:

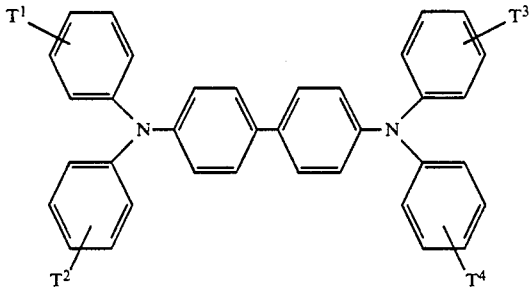

where $T^1$ to $T^4$ are H or non-ionic substituents, especially $C_1$–$C_4$ alkyl.

Triarylamines are of the general formula:

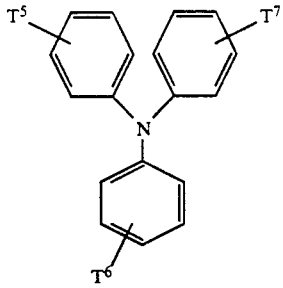

where $T^5$ to $T^7$ are H or non-ionic substituents.

Other useful CTMs include compounds of the formula:

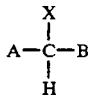

3 wherein

-continued

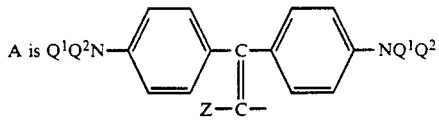

4

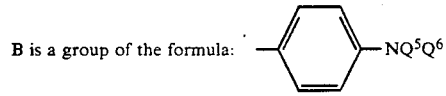

5 or

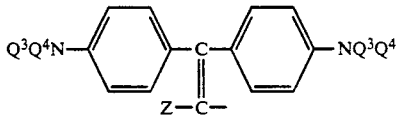

6 when B is of Formula 5,

X is of Formula 5;

when B is of Formula 6,

X is selected from H, phenyl, substituted phenyl, naphthyl, substituted naphthyl, thienyl, substituted thienyl, thiazol-5-yl and substituted thiazol-5-yl in which the substituents are selected from $NQ^7Q^8$, $NO_2$, $C_{1-4}$-alkyl, $C_{1-4}$-alkoxy, $C_{2-4}$-alkenyl, halogen, cyano and phenyl;

each Z is independently selected from H, $C_{1-4}$-alkyl, phenyl and benzyl;

each $Q^1$ & $Q^2$ is independently H, $C_{1-4}$-alkyl, trimethylene or $C_{1-4}$-alkyl-substituted trimethylene which is also attached to the ortho carbon atom of the adjacent benzene ring; or $Q^1$ & $Q^2$ together with the nitrogen atom to which they are attached form an aliphatic heterocycle;

each $Q^3$ & $Q^4$ is independently H, $C_{1-4}$-alkyl, trimethylene or $C_{1-4}$-alkyl-substituted trimethylene which is also attached to the ortho carbon atom of the adjacent benzene ring; or $Q^3$ & $Q^4$ together with the nitrogen atom to which they are attached form an aliphatic heterocycle;

each $Q^5$ & $Q^6$ is independently H, $C_{1-4}$-alkyl, trimethylene or $C_{1-4}$-alkyl-substituted trimethylene which is also attached to the ortho carbon atom of the adjacent benzene ring; or $Q^5$ & $Q^6$ together with the nitrogen atom to which they are attached form an aliphatic heterocycle;

each $Q^7$ & $Q^8$ is independently selected from H, aryl, $C_{1-4}$-alkyl, substituted $C_{1-4}$-alkyl, trimethylene and $C_{1-4}$-alkyl-substituted trimethylene which is also attached to the ortho carbon atom of the adjacent benzene ring; or $Q^7$ & $Q^8$ together with the nitrogen atom to which they are attached form an aliphatic heterocycle;

and wherein each benzene ring in Formulae 4, 5 and 6 has no further substituents or carries 1 or 2 further substituents selected from halogen, $C_{1-4}$-alkyl and $C_{1-4}$-alkoxy.

In the groups of Formulae 4 and 6 it is preferred that each Z is H.

In the compound of Formula 3 wherein B and X are both of Formula 5 it is preferred that $Q^1$ and $Q^2$ are the same and are $C_{1-4}$-alkyl, especially methyl or ethyl. It is preferred that $Q^5$ and $Q^6$ are the same and are $C_{1-4}$- alkyl, especially methyl or ethyl. However, $Q^1$ and $Q^5$ may be the same or different and it is preferred that both are methyl or ethyl or that one is ethyl and the other methyl.

In the compound of Formula 3 wherein B is of Formula 6 it is preferred that $Q^1$ and $Q^2$ are the same and are $C_{1-4}$-alkyl, especially methyl or ethyl. It is preferred that $Q^3$ and $Q^4$ are the same and are $C_{1-4}$-alkyl, especially methyl or ethyl. However, $Q^1$ and $Q^3$ may be the same or different and it is preferred that both are methyl or ethyl or that one is ethyl and the other methyl.

When B is of Formula 6 it is preferred that X is unsubstituted or substituted by a group $NQ^7Q^8$. It is further preferred that X is phenyl or substituted phenyl and more especially phenyl carrying a group $NQ^7Q^8$ in the 4-position relative to the free valency. It is also preferred that $Q^7$ and $Q^8$, which may be the same or different, are selected from H, phenyl, $C_{1-4}$-alkyl and substituted $C_{1-4}$-alkyl. The substituent on the substituted alkyl group, $Q^7$ or $Q^8$, is preferably selected from hydroxy, halogen, cyano, aryl, especially phenyl, $C_{1-4}$-alkoxy, $C_{1-4}$-alkoxy-$C_{1-4}$-alkoxy, $C_{1-4}$-alkylcarbonyl, $C_{1-4}$-alkoxycarbonyl, $C_{1-4}$-alkylcarbonyloxy, $C_{1-4}$-alkoxycarbonyloxy and $C_{1-4}$-alkoxy-$C_{1-4}$-alkoxycarbonyl. It is especially preferred that $Q^7$ and $Q^8$ are both methyl or ethyl. The phenyl group in X may also carry one or two further substituent in the 2 or 2 and 5 positions with respect to the free valency, selected from $C_{1-4}$-alkyl, $C_{1-4}$-alkoxy, halogen and $C_{1-4}$-alkylaminocarbonyl.

The halogen atom or atoms which may be present in the compound of Formula 3 are preferably chlorine or bromine.

When one or more of the substituents $Q^1$, to $Q^8$ is trimethylene or $C_{1-4}$-alkyl-substituted trimethylene attached to an ortho carbon atom in the adjacent benzene ring, the compound of Formula 3 may carry up to four tetrahydroquinolinyl or julolidinyl groups each of which may contain up to 6 alkyl groups, especially methyl. Examples of such systems are tetrahydroquinolin-6-yl and 1,2,2,4-tetramethyltetrahydroquinolin-6-yl. Heterocyclic groups which may be formed by $Q^1$ and $Q^2$, $Q^3$ and $Q^4$, $Q^5$ and $Q^6$ or $Q^7$ and $Q^8$, together with the nitrogen atoms to which they are attached, include pyrrolidin-1-yl, piperidin-1-yl, piperazin-1-yl and morpholin-4-yl.

Compounds of Formula 3 in which B and X are of Formula 5 may be prepared by condensing an olefin of the formula:

7

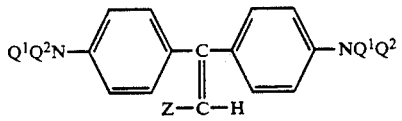

with a benzhydrol of the formula:

8

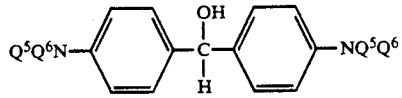

wherein the substituents Z, $Q^1$, $Q^2$, $Q^5$ and $Q^6$ have the meanings given above, in the presence of a condensing agent, such as 4-toluenesulphonic acid.

Compounds of Formula 3 in which B is of Formula 6 and X is phenyl carrying a group $NQ^7Q^8$ in the 4-position with respect to the free valency may be prepared by condensing one mole of an olefin of Formula 7 and one mole of an olefine of the formula:

9

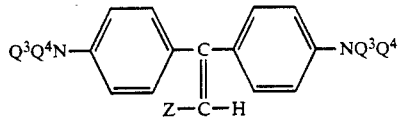

with one mole of an aldehyde of the formula:

10

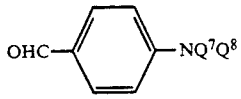

wherein $Q^7$ and $Q^8$ have the meanings given above, preferably in the presence of a condensing agent, such as 4-toluenesulphonic acid. Equivalent compounds in accordance with Formula 3, in which X is one of the other options herebefore described, may be prepared using the same process in which the substituted benzaldehyde of Formula 10 is replaced by another benzaldehyde or a naphthaldehyde, thienaldehyde or thiazolaldehyde.

The electrically conducting support may be a metal support preferably in the form of a drum or a composite material comprising an insulating supporting material such as a sheet of polymeric material, e.g. a polyester sheet or film, coated with a thin film of a conducting material, e.g. a metal such as aluminium, in the form of a drum or a continuous belt.

The CGL may comprise the phthalocyanine and the dibromoanthanthrone alone preferably in the form of a layer or layers deposited on the substrate, or the phthalocyanine and dibromoanthanthrone may be dispersed in a resin and formed into a layer or layers on the substrate. Examples of suitable resins for use in the charge generating phase are polycarbonate, polyester, polystyrene, polyurethane, epoxy, acrylic, styrene-acrylic, melamine and silicone resins. The phthalocyanine and dibromoanthanthrone may be present in a single layer or, alternatively, the two CGMs may be in separate layers. Where the resin does not have good adhesive properties with respect to the substrate, e.g. a polycarbonate resin, adhesion between the resin and the substrate may be improved by the use of an adhesive resin. Specific examples of suitable resins for use in the charge generating phase are LEXAN 141 Natural (available from General Electric Plastics, Europe) and Styrene-Acrylate Resin E048 (available from Synres Nederland BV). A suitable adhesive resin for bonding the charge generating phase to the substrate is VMCA (available from Union Carbide).

The CTL preferably comprises a layer of a resin containing a CTM and preferably has a thickness from 1.0 microns ($\mu$) to 50$\mu$ and more preferably from 5.0$\mu$ to 30$\mu$. Examples of suitable resins for use in the charge transport phase include one or more of polycarbonate, polyester, polystyrene, polyurethane, epoxy, acrylic, styrene-acrylic, melamine and silicone resins.

The CGMs and CTMs may be incorporated in the CGL and CTL and the OPC may be prepared using methods described in the prior art.

The invention is illustrated but not limited by the following Examples.

EXAMPLE 1

A solution of 1 g of VMCA in 50 ml of 1,2-dichloroethane is prepared with the aid of ultrasound. This solution is applied to an aluminium sheet using a No. 1 K bar and dried at 80° C. for 1 hour to give a coating of 0.1 micron.

A solution of 42.4 g of Lexan 141 polycarbonate in 450 ml of 1,2-dichloroethane is prepared by refluxing for 3 hours. The solution is cooled, filtered through a sinter and made up to 607.6 g with 1,2-dichloroethane. 6.45 g of this solution, 0.45 g of CGM (see Table 1 for composition), 6.05 g of 1,2-dichloroethane and 25 g of 3 mm glass beads are placed in a 2 oz WNSC bottle, sealed with MELINEX film and shaken for 1 hour on a Red Devil shaker. This dispersion is then applied to the first coating using a K bar and dried at 80° C. for 1 hour to give a second coating of 3 microns.

A solution of 1.5 g of charge transport compound in 21.5 g of the Lexan 141 solution is then applied to the second coating using a K bar and dried at 80° C. for 3 hours.

Testing Method

The OPC device so obtained is tested using a Kawaguchi Electric Works Model SP428 Electrostatic Paper Analyser, in the dynamic mode. The surface voltage after charging for 10 seconds is measured, followed by the % dark decay after 5 seconds. The sensitivity in lux-sec is the light energy (intensity × time) required to reduce the surface voltage to half of its initial value. The residual voltage is that voltage remaining after 10X the above light energy has fallen on the surface. The results obtained using a leuco triphenylmethane and/or hydrazone charge transport material are shown below.

TABLE 1

Test Conditions

| | |
|---|---|
| Corona Voltage | −6kV |
| Light Intensity (effective) | 5 lux |
| Temperature | 24.5° C. |
| Relative Humidity | 39.5% |

| | % age | | | | | | | | | | |
|---|---|---|---|---|---|---|---|---|---|---|---|
| Ex | DBA | X-$H_2$Pc | KBar | CTM | KBar | $V_1$ | $V_2$ | % DD | Lux | Sens | RP |
| 1a | 100 | — | 5 | TPM | 8 | 900 | 710 | 22.0 | 30 | 10.25 | 30* |
| b | 99.99 | 0.01 | 5 | TPM | 8 | 900 | 710 | 22.0 | 30 | 10.5 | 30* |
| c | 99.95 | 0.05 | 5 | TPM | 8 | 935 | 715 | 23.5 | 30 | 9.5 | 20 |
| d | 99.5 | 0.5 | 5 | TPM | 8 | 930 | 740 | 20.4 | 30 | 10.0 | 25 |
| e | 95 | 5.0 | 5 | TPM | 8 | 940 | 740 | 21.3 | 30 | 9.5 | 30 |
| f | 50 | 50 | 5 | TPM | 8 | 1045 | 795 | 23.9 | 30 | 4.5 | 40 |
| g | 50 | 50 | 5 | TPM/HYD 50/50 | 8 | 820 | 525 | 36.0 | 30 | 4.75 | 20 |
| h | 50 | 50 | 5 | HYD | 8 | 540 | 215 | 60.2 | 30 | 3.0 | 40 |
| i | 50 | 50 | 1 | TPM | 8 | 1050 | 880 | 16.2 | 30 | 4.75 | 40 |
| j | 50 | 50 | 1 | TPM/HYD 50/50 | 8 | 955 | 755 | 20.9 | 30 | 3.25 | 20 |
| k | 50 | 50 | 1 | HYD | 8 | 710 | 500 | 29.6 | 6 | 1.5 | 5 |
| l | 50 | 95 | 1 | HYD | 8 | 650 | 475 | 26.9 | 6 | 1.05 | 10 |
| m | 0.5 | 99.5 | 1 | HYD | 8 | 670 | 510 | 23.9 | 6 | 1.10 | 10 |
| n | 0.05 | 99.95 | 1 | HYD | 8 | 680 | 515 | 24.3 | 6 | 1.05 | 10 |
| o | 0.01 | 99.99 | 1 | HYD | 8 | 710 | 555 | 21.8 | 6 | 1.10 | 10 |
| p | — | 100 | 1 | HYD | 8 | 680 | 520 | 23.5 | 6 | 1.10 | 10 |

*at 20 secs.

Referring to the abbreviations used in Table 1:

"DBA" is dibromoanthanthrone;

"X-$H_2$PC" is the X-form of metal-free phthalocyanine;

"TPM" is a leuco triphenylmethane compound of the formula:

11

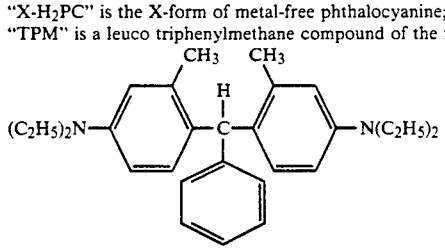

"HYD" is a hydrazone compound of the formula:

12

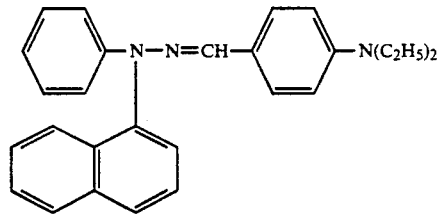

Example 1 shows that a near ir/visible panchromatic OPC can be produced from a mixture, especially a 50:50 mixture, of X-$H_2$Pc and DBA coupled with the appropriate CTM. With the TPM(1) as CTM, an OPC having high CA (1050 V) coupled with high sensitivity (4.75 lux-sec) is obtained in Example 1i. The dark decay and residual potential are also good. Similar results are obtained whether a thick (No. 5 K-bar=3.0 micron layer: Ex.1f) or thin (No. 1 K-bar=ca. 0.1 micron layer: Ex.1i) CGL is used in Table 1. This combination of high CA and low DD coupled with high sensitivity is both unexpected and difficult to achieve since CA and DD depend upon good insulating properties whereas high sensitivity (=low numerical figure) depends upon good photoconductive properties. Usually, there is a tradeoff between these properties.

Compared to the TPM(1), the hydrazone (2) as CTM gives improved sensitivity but worse CA and DD. The OPC properties of the 50:50 mixture of DBA and X-$H_2Pc$ are good. Unlike the TPM case, the thickness of the CGL has a marked effect; a thin CGL (Ex.1k) gives a better OPC performance than a thick CTM (Ex.1h). This is also the case when a CTM compound of 50:50 hydrazone:TPM is employed in Ex.1g and Ex.1j. Indeed, Ex.1j highlights the unexpected synergy from a combination of DBA, X-$H_2Pc$, TPM and hydrazone; the CA is higher than either DBA/TPM (Ex.1a) or X-$H_2Pc$/hydrazone (Ex.1p)-these are the best CGM/CTM combinations-the DD is better (lower) than either DBA/TPM or X-$H_2Pc$/hydrazone and the sensitivity is better than the expected means (3.25 vs. mean wt. 6.2).

By a suitable selection of CGM/CTM, it is possible to provide a visible/near ir panchromatic OPC having:

(i) Very high sensitivity (Ex.1k)

(ii) Very high CA and low DD coupled with good sensitivity (Ex.1i)

(iii) Good compromise of properties (Ex.1j).

EXAMPLE 2

DBA (Monolite Red 2Y) and alpha form metal free phthalocyanine were used in proportions of 90:10, 75:25 and 50:50 as a panchromatic CGM for the visible region. Two coating thicknesses were evaluated. The hydrazone (2) was used as the CTM. The results are shown in Table 2.

TABLE 2

| CTM = Hydrazone. Temp = 25° C. RH = <30%. −6 kv. 30 lux. | | | | | |
|---|---|---|---|---|---|
| Sample | $V_1$ | $V_2$ | % DD | Sensitivity | RP |
| CONTROL Monolite Red 2Y Bx.786/2 No. 1 K-bar | 685 | 475 | 30.66 | 4.50 | 5 |
| CONTROL Monolite Red 2Y Bx.786/2 No. 3 K-bar | 740 | 455 | 38.51 | 3.50 | 10 |
| 90% Monolite Red 2Y 10% alpha-form No. 1 K-bar | 700 | 470 | 32.86 | 5.00 | 10 |
| 90% Monolite Red 2Y 10% alpha-form No. 3 K-bar | 710 | 400 | 43.66 | 3.25 | 0 |
| 75% Monolite Red 2Y 25% alpha-form No. 1 K-bar | 695 | 475 | 31.65 | 5.00 | 0 |
| 75% Monolite Red 2Y 25% alpha-form No. 3 K-bar | 660 | 365 | 44.70 | 2.75 | 0 |
| 50% Monolite Red 2Y 50% alpha-form No. 1 K-bar | 555 | 325 | 41.44 | 4.0 | 0 |
| 50% Monolite Red 2Y 50% alpha-form No. 3 K-bar | 620 | 320 | 48.39 | 3.25 | 0 |
| CONTROL alpha-$H_2Pc$ No. 1 K-bar | 770 | 570 | 26.0 | 3.4 | 0 |

The results show that 25% alpha-form: 75% DBA gives the optimum performance, giving the highest sensitivity and zero residual potential coupled with reasonable CA and DD.

The thicker CGM layer (No. 3 K-bar) performs better than the thinner CGM layer (No. 1 K-bar), giving better sensitivity and generally better CA, although the DD is worse.

EXAMPLE 3

As for Example 2 but using the leuco TPM (1) as the CTM instead of the hydrazone (2). The results are shown in Table 3.

TABLE 3

| CTM = Leuco TPM | | | | | |
|---|---|---|---|---|---|
| Sample | $V_1$ | $V_2$ | % DD | Sensitivity | RP |
| CONTROL Monolite Red 2Y Bx.786/2 No. 1 K-bar | 940 | 800 | 14.89 | 15.75 | 80 |
| CONTROL Monolite Red 2Y Bx.786/2 No. 3 K-bar | 1130 | 940 | 16.81 | 11.00 | 70 |
| 90% Monolite Red 2Y 10% alpha-form No. 1 K-bar | 1040 | 900 | 13.46 | 18.5 | 180 |
| 90% Monolite Red 2Y 10% alpha-form No. 3 K-bar | 1140 | 940 | 17.54 | 12.00 | 70 |
| 75% Monolite Red 2Y 25% alpha-form No. 1 K-bar | 1020 | 880 | 13.75 | 14.5 | 100 |
| 75% Monolite Red 2Y 25% alpha-form No. 3 K-bar | 1160 | 960 | 17.24 | 10.25 | 50 |
| 50% Monolite Red 2Y 50% alpha-form No. 1 K-bar | 910 | 780 | 14.28 | 13.5 | 90 |
| 50% Monolite Red 2Y 50% alpha-form No. 3 K-bar | 1200 | 990 | 17.5 | 10.25 | 60 |

The results show that 25:75 and 50:50 alpha-form to DBA are best. The TPM as the CTM gives better (higher) CA, better DD (lower) but worse sensitivity (lower) and worse RP (higher) than the hydrazone as CTM. Again, thicker (No. 3 K-bar) CGM layers give better CA (higher) and sensitivity (higher) than thinner (No. 1 K-bar) CGM layers.

EXAMPLE 4

In this example, the optimum ratio of DBA to alpha-form metal free phthalocyanine of 75:25 is used as the panchromatic CGM of an optimum coating thickness (No. 3 K-bar) with mixture of the leuco TPM and hydrazone as one CTM and the novel CTM (3) as the other CTM. The results are shown in Table 4.

TABLE 4

| Temp = 24° C. RH = 30%. −6kv. 30 lux. | | | | | |
|---|---|---|---|---|---|
| Sample | $V_1$ | $V_2$ | % DD | Sensitivity | RP |
| CONTROL Monolite Red 2Y CTM 100% Leuco TPM | 1150 | 950 | 17.39 | 9.00 | 30 |
| CONTROL Monolite Red 2Y (B1) | 950 | 700 | 26.32 | 5.25 | 10 |
| 100% Novel CTM (B2) | 950 | 700 | 26.32 | 5.75 | 10 |
| Mixture with 85% Leuco (C1) | 1190 | 940 | 21.01 | 8.25 | 80 |
| and 15% Hydrazone (C2) | 1220 | 970 | 20.49 | 8.50 | 100 |
| Mixture with 80% Leuco and 20% hydrazone | 1080 | 820 | 24.07 | 7.50 | 20 |
| Mixture with 75% Leuco and 25% hydrazone | 1030 | 760 | 26.21 | 7.00 | 10 |
| Mixture with 100% Novel CTM | 990 | 710 | 28.28 | 5.75 | 10 |

N.B.

B1 and B2 (and C1 and C2) Readings taken from different corners of same template.

In both cases, the charge up curve was jagged.

Pigment Control 100% Monolite Red 2Y. Mixture. 75% Monolite Red 2Y + 25% alpha-form metal-free phthalocyanine.

Good OPC performance is obtained. The best results are with a leuco TPM:hydrazone ratio of 75:25 and with 100% of the novel CTM (3).

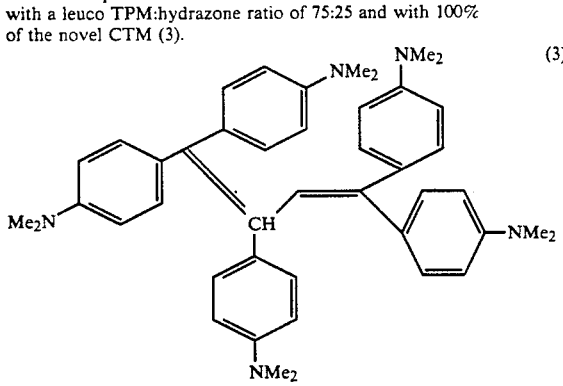

(3)

EXAMPLE 5

As per Example 4 in that a 75:25 mixture of DBA and metal free phthalocyanine is used as the CGM coated with a No. 3 K-bar. However, in this case when the alpha-form is used the CTM is a mixture of the leuco TPM (1) and the novel CTM (3). Also, the beta form metal free phthalocyanine is used since this is the most stable polymorph and the easiest and least expensive to manufacture. The results are shown in Table 5.

TABLE 5

| Temp = 22° C. RH = 30%. 1600 V 30 lux. | | | | | | |
|---|---|---|---|---|---|---|
| Pigment | CTM | $V_1$ | $V_2$ | % DD | Sens | RP |
| 100% Monolite Red 2Y | 100% Leuco | 1130 | 930 | 17.70 | 10.00 | 50 |
| 100% Monolite Red 2Y | 100% Novel (B1) | 940 | 720 | 23.40 | 6.00 | 20 |
| 100% Monolite Red 2Y | 100% Novel (B2) | 920 | 690 | 25.00 | 5.00 | 10 |
| 75% Monolite | 100% Novel | 980 | 710 | 27.55 | 5.50 | 10 |
| Red 2Y/25% alpha | 50/50 Novel/Leuco | 1100 | 860 | 21.82 | 9.50 | 40 |
| | 80/20 Novel/Leuco | 1020 | 760 | 25.49 | 8.25 | 40 |
| 75% Monolite | 80/20 Leuco/HYD | 1150 | 840 | 26.96 | 9.50 | 40 |
| Red 2Y/25% beta | 75/25 Leuco/HYD | 1030 | 820 | 20.39 | 9.25 | 30 |
| | 100% Novel | 920 | 580 | 36.95 | 7.00 | 10 |

EXAMPLE 6

As per Example 4 in that a 90:10 mixture of DBA and alpha form metal free phthalocyanine is used as the CGM coated with a No. 3 K bar. The CTM is a mixture of leuco TPM (1) and the hydrazone of formula

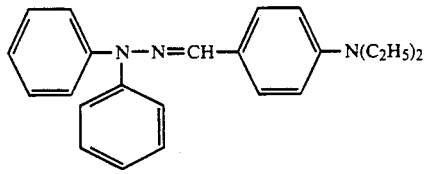

The results are shown in Table 6.

TABLE 6

| Temp = 22° C. RH = 33%. −6 kV 30 lux. | | | | | | |
|---|---|---|---|---|---|---|
| Sample CGM | CTM | $V_1$ | $V_2$ | % DD | Sens | RP |
| 90% Monolite Red 2Y 10% alpha-form | 100% Leuco | 1000 | 840 | 16.0 | 9.75 | 65 |
| 90% Monolite Red 2Y 10% alpha-form | 80% Leuco 20% Hydrazone | 920 | 715 | 22.3 | 8.0 | 100 |
| 90% Monolite Red 2Y 10% alpha-form | 60% Leuco 40% Hydrazone | 880 | 610 | 30.7 | 7.0 | 80 |
| 90% Monolite Red 2Y 10% alpha-form | 60% Leuco 40% Hydrazone | 760 | 490 | 35.5 | 6.25 | 40 |
| 90% Monolite Red 2Y 10% alpha-form | 20% Leuco 80% Hydrazone | 700 | 410 | 41.4 | 5.25 | 40 |
| 90% Monolite Red 2Y 10% alpha-form | 100% Hydrazone | 565 | 260 | 54.0 | 4.25 | 15 |

I claim:

1. An organic photoconductor comprising an electrically conducting support, a charge generation layer containing dibromoanthanthrone and a metal-free phthalocyanine in the alpha- or X-form, both the dibromoanthanthrone and phthalocyanine being dispersed in a same single resin, and a charge transport layer containing a charge transport material selected from the group consisting of leuco di-arylmethanes, leuco tri-arylmethanes, hydrazones and triarylamines.

2. An organic photoconductor according to claim 1 wherein the mixture of phthalocyanine and dibromoanthanthrone in the charge generation layer contains from 5 to 50% by weight of phthalocyanine.

3. An organic photoconductor according to claim 1 wherein the leuco di- or tri-arylmethane is of the formula:

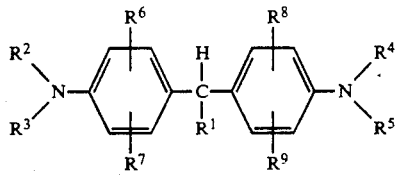

Formula 1 wherein

R′ is selected from the group consisting of hydrogen and an optionally substituted alkyl, alkenyl, cycloalkyl, cycloalkenyl, aralkyl or aryl radical;

each of $R^2$, $R^3$, $R^4$ and $R^5$, independently, is selected from the group consisting of hydrogen and an optionally substituted alkyl, alkenyl, cycloalkyl, aralkyl or aryl radical, or $R^2$ and $R^3$ together with the attached nitrogen atom and $R^4$ and $R^5$ together with the attached nitrogen atom may form heterocyclic rings; and each of $R^6$, $R^7$, $R^8$ and $R^9$, independently, is selected from the group consisting of a hydrogen atom, halogen atom, hydroxy group, alkyl group and alkoxy group.

4. An organic photoconductor according to claim 1 wherein the hydrazone is of the formula:

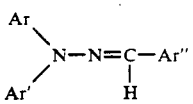

Formula 2 wherein each of Ar, Ar′ and Ar″, independently is selected from the group consisting of phenyl and naphthyl radical, each of which may optionally carry one or more non-ionic substituents.

5. An organic photoconductor comprising an electrically conducting support, a charge generation layer containing dibromoanthanthrone and a metal-free phthalocyanine in the alpha- or X-form, both the dibromoanthanthrone and phthalocyanine being dispersed in a same, single resin and a charge transport layer wherein the charge transport material comprises a mixture of a leuco di- or tri-arylmethane of Formula (1):

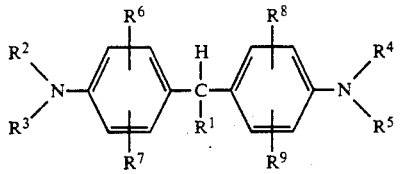

Formula 1 wherein $R^1$ is selected from the group consisting of hydrogen and an optionally substituted alkyl, alkenyl, cycloalkyl, cycloalkenyl, aralkyl or aryl radical;

each of $R^2$, $R^3$, $R^4$ and $R^5$, independently, is selected from the group consisting of hydrogen and an optionally substituted alkyl, alkenyl, cycloalkyl, aralkyl or aryl radical, or $R^2$ and $R^3$ together with the attached nitrogen atom and $R^4$ and $R^5$ together with the attached nitrogen atom may form heterocyclic rings; and each of $R^6$, $R^7$, $R^8$ and $R^9$, independently, is selected from the group consisting of a hydrogen atom, halogen atom, hydroxy group, alkyl group and alkoxy group;

and a hydrazone of Formula (2):

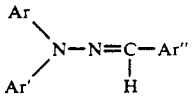

Formula 2 wherein each of Ar, Ar′, and Ar″, independently is selected from the group consisting of a phenyl and naphthyl radical, each of which may optionally carry one or more non-ionic substituents.

6. An organic photoconductor according to claim 5 wherein the charge transport material comprises from 50 to 95% by weight of a compound of Formula 1 and from 50 to 5% by weight of a compound of Formula 2.

* * * * *